US005698667A

United States Patent [19]

Speaks et al.

[11] Patent Number: 5,698,667

[45] Date of Patent: Dec. 16, 1997

[54] PRETREATMENT OF WOOD PARTICULATES FOR REMOVAL OF WOOD EXTRACTIVES

[75] Inventors: Jerry R. Speaks, Union; Roger O. Campbell; Michael A. Veal, both of Federal Way, all of Wash.

[73] Assignees: Weyerhaeuser Company, Tacoma; North Pacific Paper Corporation, Longview, both of Wash.

[21] Appl. No.: 579,475

[22] Filed: Dec. 27, 1995

[51] Int. Cl.[6] ..... C09F 1/02; D21C 3/20

[52] U.S. Cl. ..... 530/202; 162/74

[58] Field of Search ..... 530/202; 162/74

[56] References Cited

U.S. PATENT DOCUMENTS

| | | | |
|---|---|---|---|
| 1,919,623 | 7/1933 | Dreyfus | 127/37 |
| 2,022,654 | 12/1935 | Dreyfus | 127/37 |
| 2,106,797 | 2/1938 | Dreyfus | 127/37 |
| 2,273,039 | 2/1942 | Hudson . | |
| 2,435,218 | 2/1948 | Hudson . | |
| 2,538,457 | 1/1951 | Hudson . | |
| 2,840,459 | 6/1958 | Karnofsky | 554/12 |
| 3,619,351 | 11/1971 | Kolosh . | |
| 3,635,789 | 1/1972 | Green, Jr. | 162/5 |
| 3,963,560 | 6/1976 | Mestetsky et al. | 162/5 |
| 4,029,515 | 6/1977 | Kiminki et al. | 127/37 |
| 4,100,016 | 7/1978 | Diebold et al. | 162/16 |
| 4,145,345 | 3/1979 | Beemsterboer et al. | 260/239.3 T |
| 4,308,200 | 12/1981 | Fremont | 530/200 |
| 4,313,011 | 1/1982 | Weil et al. | 585/240 |
| 4,324,710 | 4/1982 | Davis et al. | 564/76 |
| 4,409,032 | 10/1983 | Paszner et al. | 127/37 |
| 4,446,651 | 5/1984 | Spitz, Jr. et al. | 47/10 |
| 4,470,851 | 9/1984 | Paszner et al. | 127/37 |
| 4,496,426 | 1/1985 | Baumeister et al. | 162/19 |
| 4,515,713 | 5/1985 | Wideman et al. | 530/206 |
| 4,520,105 | 5/1985 | Sinner et al. | 435/163 |
| 4,548,675 | 10/1985 | Gordy | 162/26 |
| 4,563,273 | 1/1986 | Gessler | 210/94 |
| 4,594,130 | 6/1986 | Chang et al. | 162/16 |
| 4,595,507 | 6/1986 | Chang et al. | 210/638 |
| 4,599,138 | 7/1986 | Lindahl . | |
| 4,599,190 | 7/1986 | Maloney | 252/174.24 |
| 4,617,126 | 10/1986 | Funk et al. | 210/651 |
| 4,684,740 | 8/1987 | Higuchi et al. | 549/464 |
| 4,764,596 | 8/1988 | Lora et al. | 530/507 |
| 4,776,926 | 10/1988 | Lindahl . | |
| 4,810,510 | 3/1989 | Lever et al. | 426/433 |
| 4,919,754 | 4/1990 | Mollett et al. | 162/5 |
| 4,941,944 | 7/1990 | Chang | 162/17 |
| 4,950,751 | 8/1990 | DeWitt | 536/128 |
| 4,977,839 | 12/1990 | Fochtman et al. | 110/346 |
| 4,996,258 | 2/1991 | Wideman et al. | 524/274 |
| 5,010,156 | 4/1991 | Cook et al. | 527/403 |
| 5,073,234 | 12/1991 | Mollett et al. | 162/5 |
| 5,134,023 | 7/1992 | Hsu | 162/174 |
| 5,176,796 | 1/1993 | Irie et al. | 428/288 |
| 5,221,357 | 6/1993 | Brink | 127/43 |
| 5,252,183 | 10/1993 | Shaban et al. | 162/77 |
| 5,259,969 | 11/1993 | Srivatsa et al. | 252/60 |
| 5,362,362 | 11/1994 | Cunningham et al. | 162/5 |
| 5,366,558 | 11/1994 | Brink | 127/43 |
| 5,370,770 | 12/1994 | Johnson et al. | 162/6 |
| 5,389,200 | 2/1995 | Cody et al. | 162/5 |
| 5,413,675 | 5/1995 | Ikonomou et al. | 162/41 |
| 5,431,729 | 7/1995 | Hegge | 106/659 |

FOREIGN PATENT DOCUMENTS 60-163959 8/1985 Japan .

OTHER PUBLICATIONS

T. Chen et al., "Using solid–phase extraction to assess why aspen causes more pitch problems than softwoods in kraft pulping", *Wood and Pulping Chemistry*, vol. 78, No. 10, Oct. 1995, Tappi Journal, pp. 143–149.

J. Brandal et al., "The Influence of Extractives in Groundwood Pulp on Fibre Bonding", *Pulp and Paper Magazine of Canada*, Oct., 1966, pp. T–431–T–435.

"New Pulps 'Explode' onto Scene", *Pulp & Paper Canada*, Jun. 1987, p. 40.

*Primary Examiner*—Nathan M. Nutter

*Attorney, Agent, or Firm*—Christensen O'Connor Johnson & Kindness PLLC

[57] ABSTRACT

A process for extracting volatile organic compounds and pitch from wood particulates, thereby virtually eliminating the emission of volatile organic compounds into the atmosphere during the processing of wood particulates into commercially useful products, such as oriented strandboard, particle board, chipboard veneers, and pulp and paper products. The removal of pitch permits the production of pulps of higher brightness, requiring less chemical bleaching agents. Moreover, removal of pitch eliminates pitch scale formation in pulp mills and on pulp and paper machines with resultant improved efficiencies and reduced use of pitch treatment chemicals. In the extraction process, a solvent or blend of solvents, leach wood extractives, including volatile organic compounds and pitch, from the wood particulates to produce a miscella. The miscella is separated from the leached wood particulates and solvent contained in the miscella is recovered and recycled for reuse. The wood extractives of the miscella may be sold as chemical feedstocks or used as a fuel. Any volatile organic compounds released as vapors in wood processing operations prior to the extraction step are collected, absorbed onto activated carbon particulates, and recovered for sale or combustion.

30 Claims, 8 Drawing Sheets

PRETREATMENT OF WOOD PARTICULATES FOR REMOVAL OF WOOD EXTRACTIVES

FIELD OF THE INVENTION

The invention relates to a process for the removal of wood extractives from wood particulates without significantly affecting the integrity of cellulosic components of the wood or removing lignin. More particularly, the process of the invention uses solvent extraction techniques to remove volatile organic compounds, as well as higher molecular weight pitch compounds, from wood particulates thereby facilitating the further processing of the wood into composite boards, paper, and pulp products while significantly reducing the release of potentially harmful byproducts into the environment.

BACKGROUND OF THE INVENTION

As a preliminary matter, wood can be viewed as consisting of two major components, carbohydrates and lignin. Other components constitute a minor part of the wood and manifest as intercellular material, and extraneous substances that are related to the growth of the cells of the tree. The cell walls of the wood are composed of polysaccharides, the chief of which is cellulose. Lignin, on the other hand, is an amorphous substance, partly aromatic in nature, that has been called a "cementing material" or an "encrusting substance." It is insoluble in water and in most common organic solvents. It is also insoluble in acids, but undergoes condensation reactions in the presence of strong mineral acids. Lignin is partly soluble in alkaline solutions and is readily attacked and solubilized by oxidizing agents.

The extraneous substances of wood are deposited as cells grow, or after they reach maturity. Most of these substances are relatively simple compounds, having a low molecular weight. These low molecular weight substances include pectins, proteins, and like substances that are soluble in water or neutral organic solvents. The extraneous substances also include "wood extractives" that include pitch and volatile organic compounds.

To produce boards (oriented strand board, particleboard, veneerboard) composite wood products, and paper and pulp products, raw logs or wood fibrous material must be reduced to wood chips, flakes or sawdust. These wood particulates are then further processed, either by bonding together with a suitable glue to make board products, or undergoing pulping and forming processes to produce a variety of papers, paper boards and absorbent products. However, the processing of logs into wood particulates, and thence into finished products, poses several challenges. Some of these arise from the nature of wood, namely, that it includes not only cellulosic fibers and lignin but also "wood extractives," as discussed above. These naturally-occurring wood extractives are found in both resin canals within the structure of the wood, as well as within the parenchyma cells of the wood. In general, the extractives may be divided into a higher molecular weight, higher boiling point fraction, commonly known as "pitch", and a lower molecular weight, lower boiling point fraction that falls within the definition of "volatile organic compounds." The United States Environmental Protection Agency (EPA) has determined that volatile organic compounds (VOCs) pose an environmental hazard when they are released into the atmosphere. These VOCs are defined in 40 CFR Part 51(s) as "any compound of carbon, excluding carbon monoxide, carbon dioxide, carbonic acid, metallic carbides or carbonates, and ammonium carbonate, which participates in atmospheric photochemical reactions." Typically, these are volatile, low molecular weight organic compounds. The EPA has promulgated regulations limiting the quantity of VOCs that a manufacturing facility may release into the atmosphere.

The release of VOCs into the atmosphere is a longstanding problem in the pulp and paper industry. Since VOCs occur naturally in timber, the processing of timber into wood particulates facilitates the migration or diffusion of VOCs to chip surfaces from which the compounds vaporize into the surrounding atmosphere. As a practical matter, since the industry requires a large inventory of wood chips for processing into board products and as feedstock in the pulp and paper processes, significant amounts of VOCs are released into the atmosphere from wood chip storage piles. Further, as illustrated in FIG. 1, VOCs are also released into the atmosphere during the processing of the wood chips into wood pulp products. As shown, logs 5' are processed into chips in chip mill 10' releasing VOCs 2' to the atmosphere. In pulping process operations, the chips are stored in mounds 7' as inventory for the process. These mounds continue to release VOCs 4' to the atmosphere. Some species of wood produce more VOCs than others. For example, loblolly pine is higher in VOC content than hemlock, and Douglas fir is intermediate between these two. The VOC-containing chips are then processed in a pulp mill 12', either a mechanical, thermomechanical, semi-chemical, or a chemical pulp mill, to produce cellulosic and fibrous pulps. During this pulping process, cellulosic fibers of the wood are separated from each other thereby allowing entrapped VOCs to diffuse to fiber surfaces and vaporize into the surrounding atmosphere. The cellulosic pulp produced may be bleached, and is then formed into a continuous web and dried on a pulp drier or paper machine 14'. During these processes, a further significant amount of VOCs may be released into the atmosphere. The combined chipping, crushing, pulping, and paper or absorbent product making processes release about one-third of the total natural extractives in the wood into the atmosphere (shown by arrows 2', 4', 6', and 8') as VOCs, and another one-third into effluent water (arrows 20', 22' and 24'). The papermill product 15', such as newsprint, writing paper, or absorbent products, includes the residual of about one-third of the total amount of extractives, mainly pitch with low amounts of VOCs.

As illustrated, wood particulates are also used as a raw material in composite wood boardmaking processes. The logs are usually debarked and reduced to flakes, fibers or other particulates on site then stored in bins as inventory for the boardmaking. Before being consolidated into boards, under heat and pressure, the wood particulates are dried to a desired moisture content in ovens. VOCs are emitted into the environment from the drying ovens and also from presses used to consolidate the dried particulates, with a binder, into boards. Thus, a board manufacturing process 26' also emits VOCs 28' while making boards 30'.

While the percentage of VOCs released into the atmosphere may appear small, relative to wood particulate mass, the actual quantity is nevertheless very significant. For example, a facility may process about 1,000–6,000 tons of wood chips per day. A 6,000 ton per day facility could produce 120 tons per day of VOCs. The EPA proposes limiting the amount of VOCs that any wood chip processing facility releases into the atmosphere by regulations requiting permits. Since a wood chip processing facility represents a significant capital investment, operators must take steps to limit VOC emissions while at the same time ensuring that processing equipment operate at or near full capacity for an adequate return on investment. To date, methods for limiting the quantity of VOC emissions have focused on enclosing the atmosphere surrounding any wood chip process that may release VOCs and subjecting air within the enclosure to treatment for the removal of VOCs, before release of the air into the environment. These methods require expensive equipment including large hoods to enclose equipment, fans and ducts for transporting air containing VOCs, and incinerators for combusting VOCs in the air. The methods also have high combustion fuel costs.

The higher boiling portion of the wood extractives, the pitch, presents separate and different problems in the processes for treating wood chips to produce boards or mechanical and thermomechanical paper and pulp products. In the pulp mill, the pitch separates from the cellulosic fibers and gradually builds up a scale within the process equipment and ducting of the mill. Ultimately, the pulp mill must be shut down so that this pitch scale may be manually removed. To reduce the frequency of shut-downs to remove pitch scale, sodium aluminate and alum is added to the pulping process in an attempt to fix the pitch to the surface of the cellulosic fiber. While this alleviates the equipment fouling problem, it does not eliminate the problem. Indeed, the addition of aluminum chemicals also poses a waste disposal problem since these chemicals are present in the process water. Although this water is recycled, a portion must be treated and disposed of. Pitch control requires additional operating costs for treatment chemicals, labor and facilities, and disposal.

Pitch also causes significant equipment fouling problems in pulp dryers and papermaking machines. In these capital intensive high speed machines, the pulp is formed into continuous sheets on high speed belts, dewatered, and dried. During these processes, colloidal pitch and pitch adhering to the fibers is transferred to the rolls and machine "clothing" of the pulp or papermaking machines to form a tacky, gummy surface deposit. This ultimately results in reduced product quality and machine efficiency. Removing the gum can require shutting down the papermaking machine, chemical cleaning or removing the clothing, and cleaning all affected surfaces. This results not only in cleaning costs and paper wastage losses, but also in significant machine downtime with consequent economic loss. Other methods of treatment include the use of continuous cleaning chemicals and equipment. Some of these chemicals may contribute to the release of VOCs and compositions with high biological oxygen demand (BOD) and/or high chemical oxygen demand (COD) into the environment.

There exists a need to reduce or eliminate the release into the environment of volatile organic compounds from processing operations that convert logs into wood particulates and that convert the particulates into other useful products. Further, there also exists a need to reduce or eliminate the downtime of wood pulping facilities and papermaking machines caused by fouling of equipment by pitch that occurs naturally in wood.

SUMMARY OF THE INVENTION

The invention provides a process for removing volatile organic compounds and pitch from wood particulates. As a result, the invention substantially reduces the emission of volatile organic compounds from board making processes, chip pulping, and pulp and paper forming and drying processes. The process of the invention also substantially reduces the mount of pitch in wood particulates, thereby reducing or substantially eliminating pitch fouling of equipment in pulp processing and papermaking processes. Further, the process of the invention allows the production of a paper pulp of superior strength, brightness, and optical properties.

According to the invention, wood particulates are contacted with a solvent for the removal of wood extractives including VOCs and pitch. The solvent extracts a proportion of naturally-occurring VOCs and pitch from the particulates, and is separated as a "miscella" from the leached wood particulates. The miscella, including solvent, water, VOCs, and pitch, is subjected to a separation process that reclaims the solvent for reuse, and produces a VOC product and a pitch product, which may be sold as a chemical feedstock or used as a fuel. The leached wood particulates, containing solvent, are subjected to a compression stage to express residual solvent. Optionally, or in combination, heat may be applied to vaporize and remove residual solvent. The vaporized solvent is condensed and recycled with expressed solvent for reuse in the extraction process. The leached wood particulates, now having substantially reduced VOCs and pitch concentrations, may then be subjected to processes for the production of composite board products or pulp products or absorbent products or paper products, with significantly reduced emissions of VOCs.

The process of the invention removes from about 50 to about 100 wt % of the VOCs present in the raw wood particulates. Further, the process also removes from about 40 to about 80 wt % of the pitch. In certain embodiments of the invention it may be preferred to use a mixture of solvents, one solvent that is highly effective for the removal of VOCs, and another solvent that is highly effective for the removal of higher molecular weight pitch products. Alternatively, the wood particulates may be subjected to a two-stage treatment process: One stage using a solvent to remove saponifiable extractives (also known as "hydrophilic" extractives), and another stage using a second solvent to remove unsaponifiable extractives (also known as "hydrophobic" extractives).

The invention solves a long-standing environmental problem by reducing the amount of VOCs released into the atmosphere in processes for converting wood into useful products such as particle board, oriented strand board, paper, absorbent products, and the like. Also, by removing pitch from the wood particulates, the invention permits the realization of significant cost savings in pulp mills and papermaking machine operations. The process of the invention also allows a substantial reduction in pitch scale formation in pulp mills, and on pulp and paper machines. This results in significant improvements in mill efficiencies and reduced use of pitch treatment chemicals, in pulp processes and process water, that pose a disposal problem. Further, the removal of pitch from wood particulates provides brighter wood particulates that resist age-darkening. This allows the production of wood-containing pulp (also known as "mechanical pulp") of higher brightness, thereby reducing the demand for chemical bleaches. Additionally, the BOD and COD of process water are reduced, alleviating the need for post environmental treatment.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying simplified process flow-type drawings, not to scale, showing important process aspects of the invention and the prior art wherein.

DETAILED DESCRIPTION OF THE PREFERRED EMBODIMENT

Figure 1:
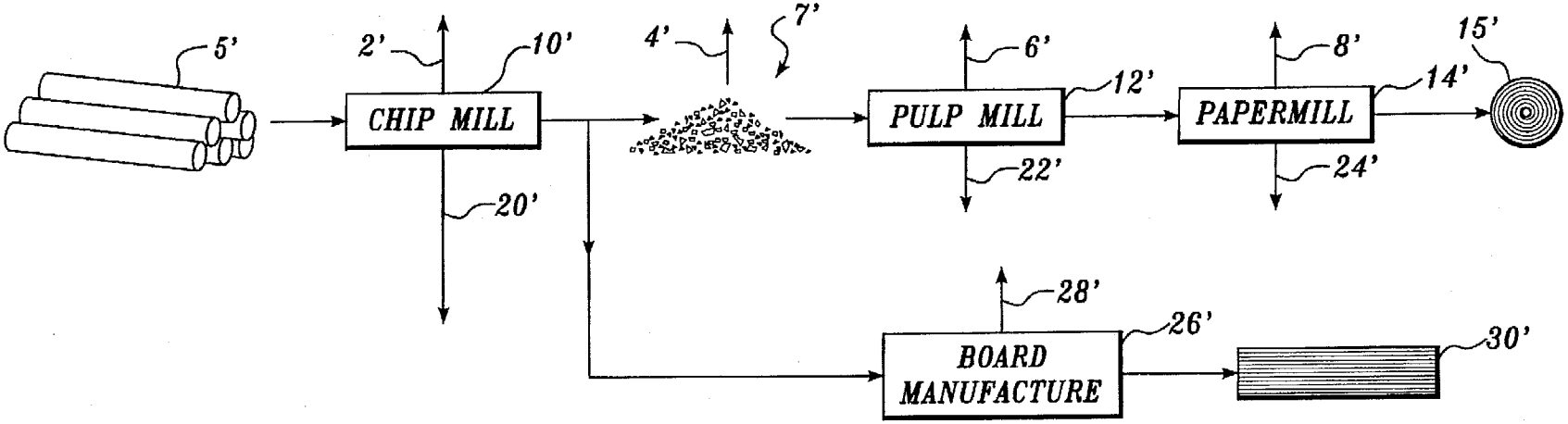
Fig. 1. (PRIOR ART)
FIG. 1 is a schematic block flow diagram of wood chip processing showing VOCs emissions in a prior art papermaking process and a prior art chipboard process.

The continuous process of the invention uses an extractive solvent, that is either a single liquid chemical compound or a mixture of such compounds, for dissolving and removing naturally occurring wood extractives from wood particulates suitable for use as chargestock in pulp and paper operations or board manufacture. The term "wood particulates" refers to wood chips, sawdust, flakes, shavings, and other such solid wood in particulate form. It should be understood, that although the following description may refer to "wood chips" the process of the invention is equally applicable to other wood particulates.

The term "wood extractives," as used in the specification and claims, refers to VOCs and pitch, and is measured as the extractives removed from wood using an ether soxhlet extraction in accordance with TAPPI Standard Test No. T204 om88 (modified to use diethyl ether as the extraction solvent). This test does not distinguish between VOCs and pitch but measures both as ether extractables of the wood. The percent wood extractives removed by the extraction process of the invention is arrived at by measuring the difference between the ether wood extractables in samples of the wood particulates before and after undergoing the extraction process of the invention.

While the specification and claims refer to VOCs and pitch as separate components of wood extractives, it is recognized that in prior art processes, not using the technology of the invention, emissions into the environment include both VOCs and pitch. Under process conditions, a proportion of non-VOC components also volatilizes and accompanies the VOCs as an emission from the process. Frequently, these volatilized wood extractives subsequently condense on process equipment, resulting in fouling. According to the present invention, VOCs and volatilized wood extractives are removed by extraction from the wood particulates.

The percentage of VOCs extracted from wood particulates is estimated by subjecting the extracted wood particulates to an oven heating procedure at 105° C. for 24 hours. The weight loss of wood particulates during this procedure corresponds to the residual VOCs remaining in the extracted particulates. Similarly, the quantity of VOCs in the raw particulates, before extraction, may be estimated by heating the particulates to 105° C. for 24 hours. Thus, the proportion of VOCs extracted may be readily estimated from the measured amounts of VOCs present in the particulates before and after extraction. The amount of pitch present before and after extraction may be found by the difference, since the total amount of wood extractives is determined by the TAPPI method, as explained above.

The term "significantly reduced pitch content" with reference to extracted wood particulates, means that at least about 40% of the naturally-occurring pitch has been extracted from the particulates. Preferably, from about 40% to about 80%, and more preferably from about 45% to about 75%, of the pitch is extracted.

The term "substantially reduced VOC content" referring to extracted wood particulates, means that at least about 40% of naturally occurring VOCs have been removed by extraction, preferably from about 50% to about 100%, most preferably from about 75% to about 95%.

Preferably, the solvent used in the extraction process of the invention is of a type that can be recycled for reuse in the process. To minimize solvent recovery costs when distillation is used in the recovery process, and to maintain the efficiency of the extraction process, it is preferred that the extractive solvent is miscible with water under process conditions and either does not form an azeotrope with water, or forms only a minimal azeotrope. In preferred embodiments, the solvent is applied to raw wood particulates that have not undergone a drying treatment to remove water, and consequently commingles with water. This process is preferred since it avoids costly drying processes. For ease of extraction, the extractive solvent should have a high affinity for wood, i.e., the solvent should readily diffuse or enter into spaces between cellulosic fibers to leach out wood extractives. To facilitate recovery and reuse of the solvent, the solvent should preferably have a physical property that allows ready separation from water, for example, a preferred solvent boils in the temperature range from about 40° to about 75° C. under atmospheric pressure conditions, to facilitate separation by distillation using steam as a heating medium. Alternatively, the solvent could boil at a temperature higher than water, although this is undesirable from an energy usage standpoint. Moreover, the solvent could be immiscible with water, as long as it is able to leach out VOCs or pitch, or both from wood particulates.

As indicated above, the extractive solvent may include a mixture of solvents. In particular, the mixture may include a first solvent that has a particularly high affinity for saponifiable components ("hydrophilic") of the extractives, and a second solvent that has a high affinity for the unsaponifiable ("hydrophobic") components. As a further alterative, according to the invention, the wood particulates may be sequentially subjected to one extractive process using a solvent for the removal of saponifiable components, and another extractive process using a different solvent for the removal of unsaponifiable components. The order of these two extraction processes is not important.

Preferably, the extraction process is carried out under as mild conditions of temperature and pressure as would require an extraction time of from about two hours to about 10 minutes, or less, to minimize equipment size for a particular rate of chips treated, in tons per hour. Most preferably, the time of extraction is about 30 minutes to about one hour for economical extraction equipment sizing. Extraction time, and hence size of equipment, is also solvent dependent. Certain solvents remove extractives at a faster rate and their leaching or solvent capability is not as strongly adversely affected by increasing concentrations of extractives in the solvent. Such solvents potentially minimize solvent recovery costs because of their faster extraction rates requiting smaller volumes of solvent.

Preferably, the mass ratio of solvent to wood particulates is in the range of from about 6:1 to about 1:1, more preferably about 4:1 to about 1:1, most preferably about 2:1. However, solvent:wood ratio also depends on extraction time and temperature and pressure conditions. Thus, longer extraction times allow a lower solvent:wood ratio for the same degree of extraction for a particular solvent. Also, higher temperatures and pressures allow reduced extraction time and reduced solvent:wood ratios. The mass ratio of solvent to wood is measured as the total mass of solvent that a particular mass of wood will encounter in a typical extractor. Thus, even if the extractor is charged with "dirty" solvent that is recycled, without first removing all wood extractives and water, the solvent:mass ratio refers to the sum of the mass of pure make-up solvent and the mass of solvent in the dirty recycled solvent stream, relative to the mass of dry wood in the extractor.

Temperature and pressure conditions also impose constraints on the selection of the solvent or solvents. Those solvents that are able to effectively remove wood extractives from wood particulates, under mild conditions of temperature and pressure, i.e., conditions that do not cause significant dissolution of lignin or significant attack of wood cellulosic components, are useful. Thus, it is preferred, within the equipment economic size constraint mentioned above, that the extraction process operate at a temperature in the range of from about 10° to about 150° C., more preferably from about 20° to about 130° C. Preferred pressure conditions range from about atmospheric pressure (14.7 psi) to about 50 psi, most preferably from about 15 to about 25 psi. Again, the combination of temperature, pressure and time of extraction should be selected to remove wood extractives without significantly affecting yield, as discussed above.

According to the invention, the preferred solvent for the extraction of VOCs is methylene chloride, 1,1,1-trichloroethane, 1,1,2-trichloro-1,2,2-trifluoroethane, trichlorofluoromethane, dichlorodifluoromethane, chlorodifluoromethane, trifluoromethane, 1,2-dichloro 1,1,2,2-tetrafluoroethane, chloropentafluoroethane, 1,1,1-trifluoro 2,2-dichloroethane, 1,1,1,2-tetrafluoroethane, 1,1-dichloro 1-fluoroethane, 1-chloro 1,1-difluoroethane, 2-chloro-1,1,1,2-tetrafluoroethane, pentafluoroethane, tetrafluoroethane, trifluoroethane, difluoroethane, parachorobenzotrifluoride, cyclic, branched, or linear completely-methylated siloxanes, acetone, methyl ethylketone, methyl isobutylketone, trichloromethane, ethyl ether, diethyl ether, methanol, ethanol, pyridines, hexanes, benzene, and the like. Other solvents may also be useful. Acetone is the most preferred solvent since it is miscible with water, forms a minimal azeotrope with water, boils at about 55° C., and has a high affinity for wood, while also being an excellent solvent for VOCs. In a preferred embodiment, wood particulates are extracted by the method of the invention without predrying of the particulates. In this embodiment, a polar solvent or mixture of solvents or a hydrophilic solvent is preferred.

In accordance with the invention, solvents for the extraction of pitch are also exemplified by the group described above. However, since pitch is of higher molecular weight, these higher molecular weight extractives are best extracted with a less polar solvent or solvent mixture. Preferably, the solvent or solvent mixture is hydrophobic in nature, for example, kerosene, cyclic saturated alkanes, such as hexane, octane, and the like. Aromatic solvents, such as benzene, xylene and toluene, are also useful, but temperature and pressure conditions should be controlled to avoid significant dissolution of lignin. Such solvents are best employed after the wood has been dried to remove water that may interfere with extraction. Most preferably, however, the solvent is acetone, in which case the wood does not have to be dried and a single solvent may be used for the extraction of both VOCs and pitch. This also facilitates recovery of the solvent by eliminating any requirement for duplication of solvent recovery apparatus. Acetone also provides ease of separability from water, low boiling point, relatively low cost, low toxicity and a favorable environmental classification.

Figure 2:
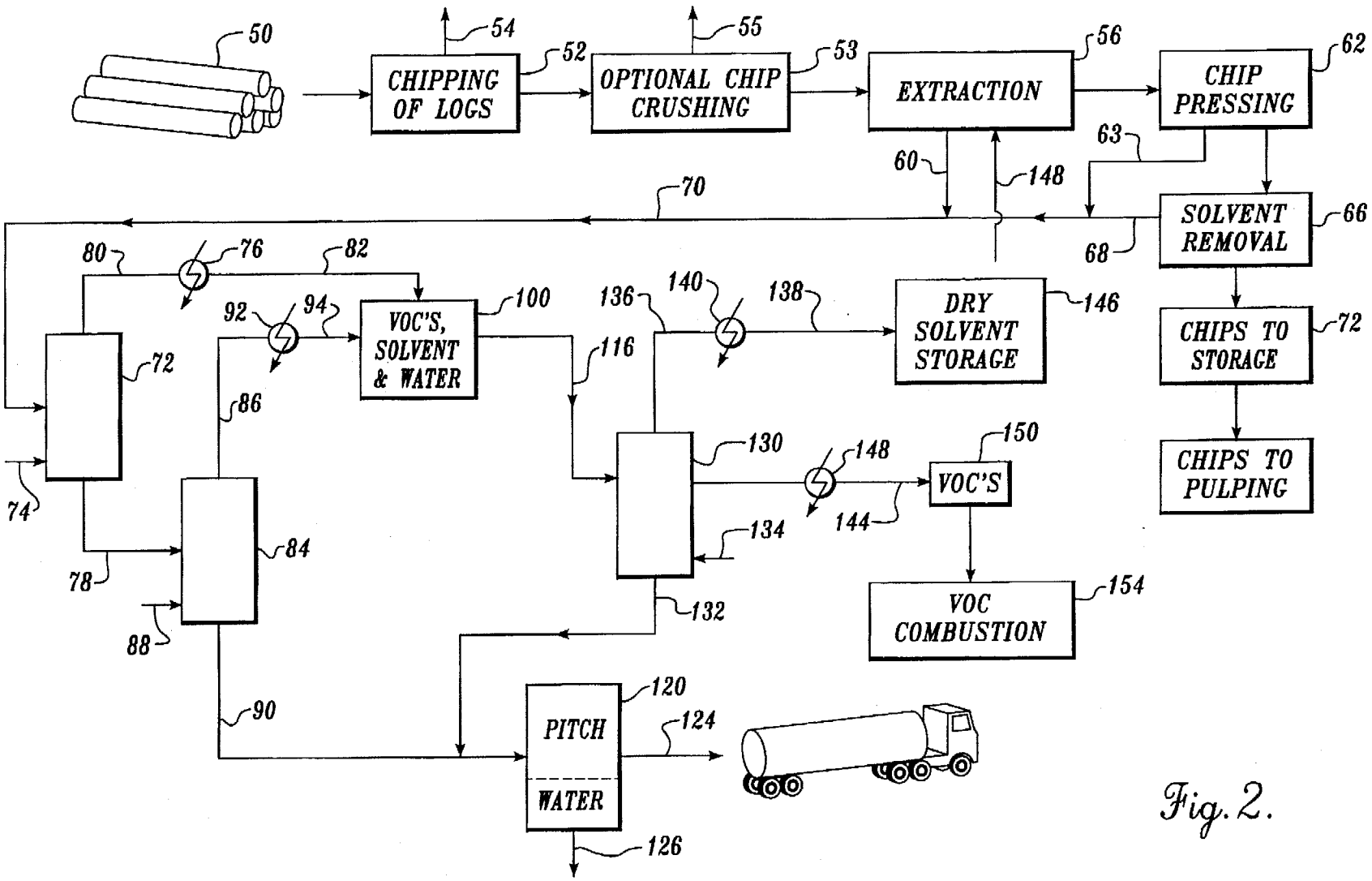
FIG. 2 is a schematic flow diagram of an embodiment of the process of the invention for VOC and pitch removal from wood chips.

For ease of understanding the process of the invention, an embodiment of the invention is illustrated in FIG. 2. As shown, raw logs 50 are charged to a chipper 52 and then an optional chip crusher 53 for increase in internal surface area. In prior art processes, during the chipping, chip crushing and storage stages, VOCs are released and emitted into the surrounding environment. As explained above, the EPA has set stringent standards on the amount of VOCs that may be emitted. The chipping and chip crushing processes may, therefore, optionally be enclosed within substantially airtight, enclosed equipment from which air containing VOCs is continuously removed, through ducts under an induced draft. This VOC-containing stream may then be purified by passage through air scrubbers and then optionally activated charcoal filters, or through activated charcoal filters only.

Following the processing of solid product, the wood chips produced in crusher 53, are charged to an extraction operation 56 that removes pitch and VOCs from the wood chips. Preferably, this process is carried out in a counter-current operation. By "countercurrent" it is meant that the freshest solvent entering the extractor contacts chips that have already flowed through most of the extractor volume, and fresh chips entering the extractor first contact solvent that has already flowed through most of the extractor. Ideally, in this type of flow arrangement, influent solvent containing the lowest concentration of extractable material, contacts chips from which a proportion of the extractives have already been removed, so that the highest driving force for extraction is maintained. This driving force is proportional to the difference between the concentration of extractives in the solvent and the concentration of extractives in the wood chips.

Figure 3A:
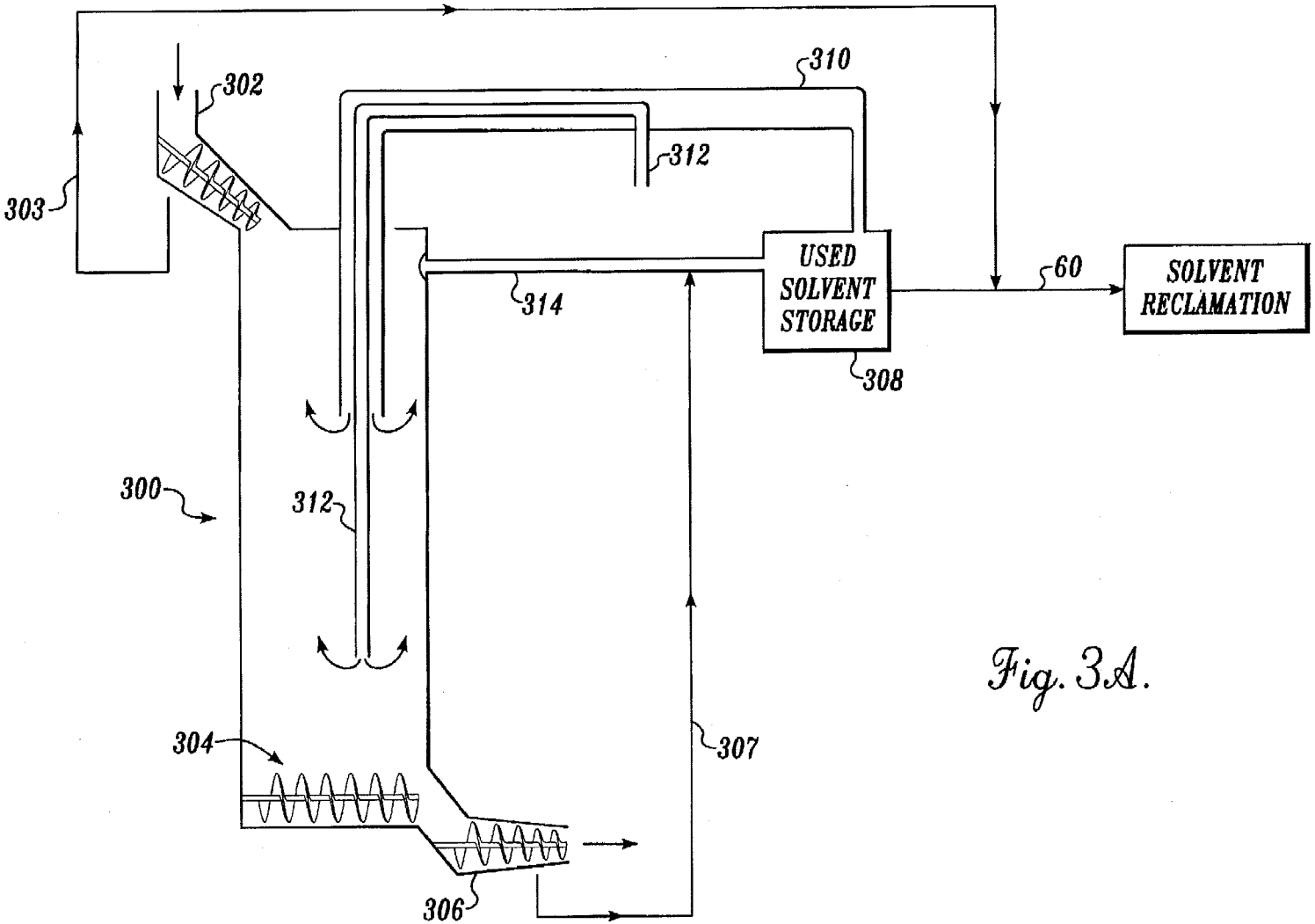
FIG. 3A is a schematic diagram of an embodiment of a chip extractor of the invention.

In the wood chip extractor shown in FIG. 3A, the extractor has a cylindrical housing 300, preferably having a length-to-diameter ratio of about 4:1. Wood chips enter the compression screw feeder 302 that includes a progressively tapering screw thread within a sleeve. Thus, as the screw thread conveys the chips toward the extractor, the chips are progressively compressed in the tapering sleeve. This type of feeder is favored because it can express some water from the chips, facilitating subsequent solvent recovery. Any water expressed in the screw feeder is drained and removed in conduit 303 and routed to VOC, pitch and solvent recovery processes. The compressed chips enter the extractor near its top and flow downward under gravitational force, and the mass of chips continuously added to the extractor. The base of the extractor is supplied with a plurality of screw feeders 304 aligned with the longitudinal axes parallel to the base of the extractor. As these screw feeders 302 rotate about the axes, they convey the chips towards the outlet compression screw feeder 306. During compression of the chips in this outlet screw feeder, residual solvent is removed from the chips. This solvent drains into conduit 307 and is routed to a used solvent storage tank 308.

In order to remove wood extractives from the chips, solvent is added in at least two points in the extractor. In order to mimic, as closely as possible, countercurrent flow conditions, fresh solvent is injected near the base of the extractor; and "dirty" solvent that has already passed through the extractor, and that contains water and wood extractives, is injected nearer the middle or upper section of the extractor. Thus, dirty solvent is controlledly pumped from the used solvent storage tank 308 through outer concentric conduit 310 into the extractor at a location about midway along the length of the extractor. Flesh solvent is injected in an inner concentric conduit 312 that terminates near the base of the extractor. Thus, as fresh solvent rises in the extractor, moving toward the exit pipe 314, it encounters chips that have already undergone extraction with dirty solvent. Consequently, the chips with the lowest concentration of wood extractives come into contact with solvent having the lowest concentration of wood extractives. This provides an optimum driving force for further extraction of wood extractives from the chips. In the upper part of the extractor, entering chips, containing naturally occurring levels of wood extractives, first encounter dirty solvent. This dirty solvent is still able to extract wood extractives from the chips because of the high concentration of extractives present in the chips.

Ideally, flow of solvent in the extractor is of a plug-flow type. Thus, there is little mixing between fresh and dirty solvent in the portion of the extractor below the fresh solvent injection point. Under these circumstances, the fresh solvent rises in the extractor as a "front" until it meets with upwardly rising dirty solvent. At that point, commingling takes place and the combined solvent mass, including extracted wood extractives, rises upward through the extractor while leaching wood extractives from chips, until the solvent exits the extractor in conduit 314 and is routed to used solvent storage 308. A portion of this solvent is continuously removed and charged through conduit 60 to a solvent reclamation process.

Figure 3B:
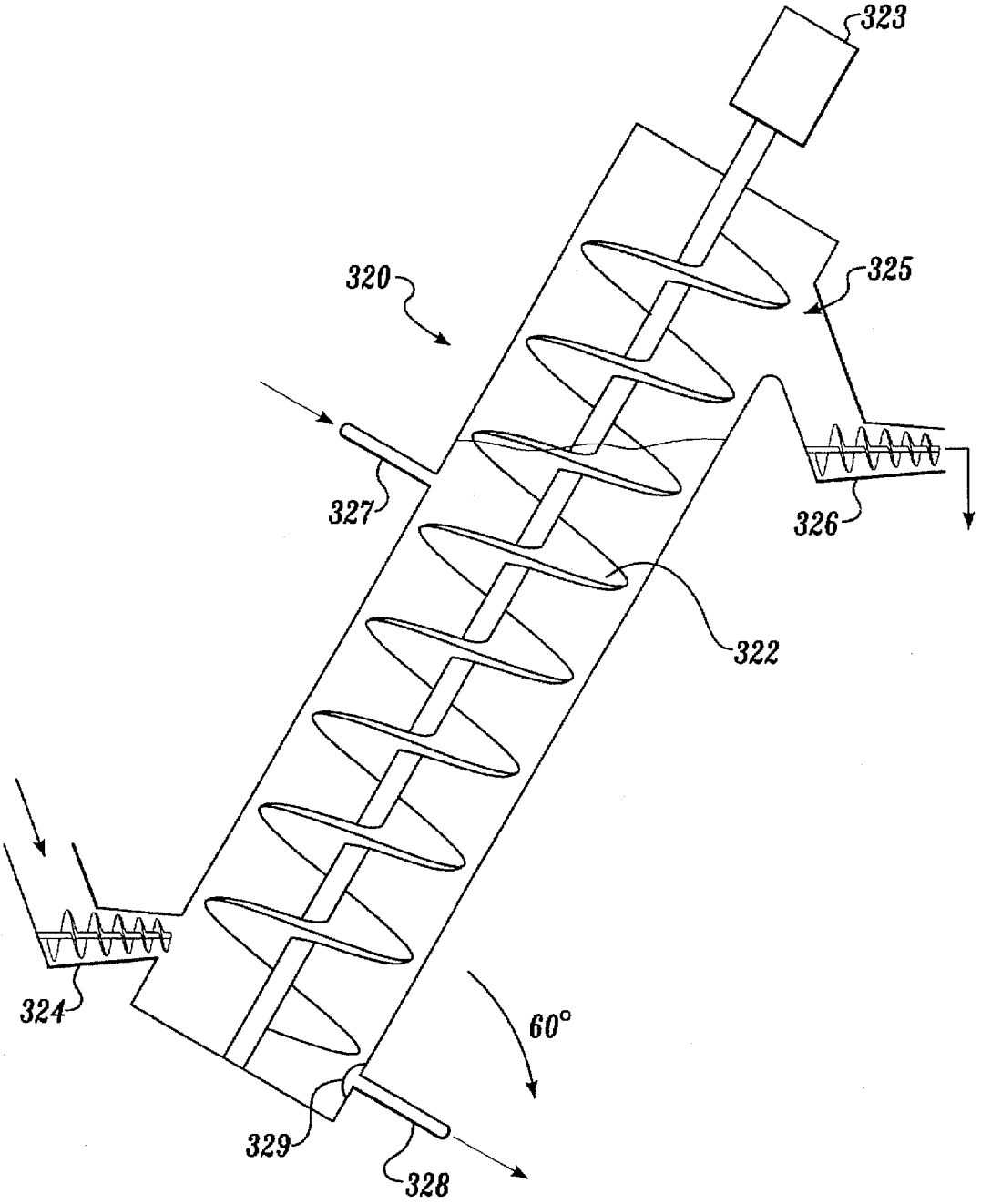
FIG. 3B is a schematic diagram of another embodiment of a chip extractor of the invention.

In an alternative embodiment of the extractor according to the invention, shown in FIG. 3B, the extractor 320 has a cylindrical body inclined at an angle of about 60° to the horizontal. The extractor is supplied with an internal screw 322 that has a longitudinal axis extending along the central longitudinal axis of the extractor and that is coupled to a drive motor 323. Threads of the screw extend outward from the root of the screw at a screw pitch angle, toward the inner surface of the extractor body 320, without touching the inner surface. Thus, the inclined screw 322 is free to rotate, under mechanical power, within the extractor. Chips are fed into the solvent-filled extractor at an inlet near the extractor base by means of a compression screw feeder 324. These chips are captured between the helical threads of the rotating inclined screw of the extractor and conveyed upward until they are expelled from the extractor through a chip outlet 325 near the upper end of the extractor into an outlet compression screw feeder 326. As explained before, the outlet compression screw feeder compresses the chips and expresses residual solvent from the chips. In order to achieve near countercurrent conditions, acetone is injected into the inclined extractor through a conduit 327 near the top of the extractor, and removed from the extractor in an outlet conduit 328 near its base supplied with a chip filter 329.

Figure 3C:
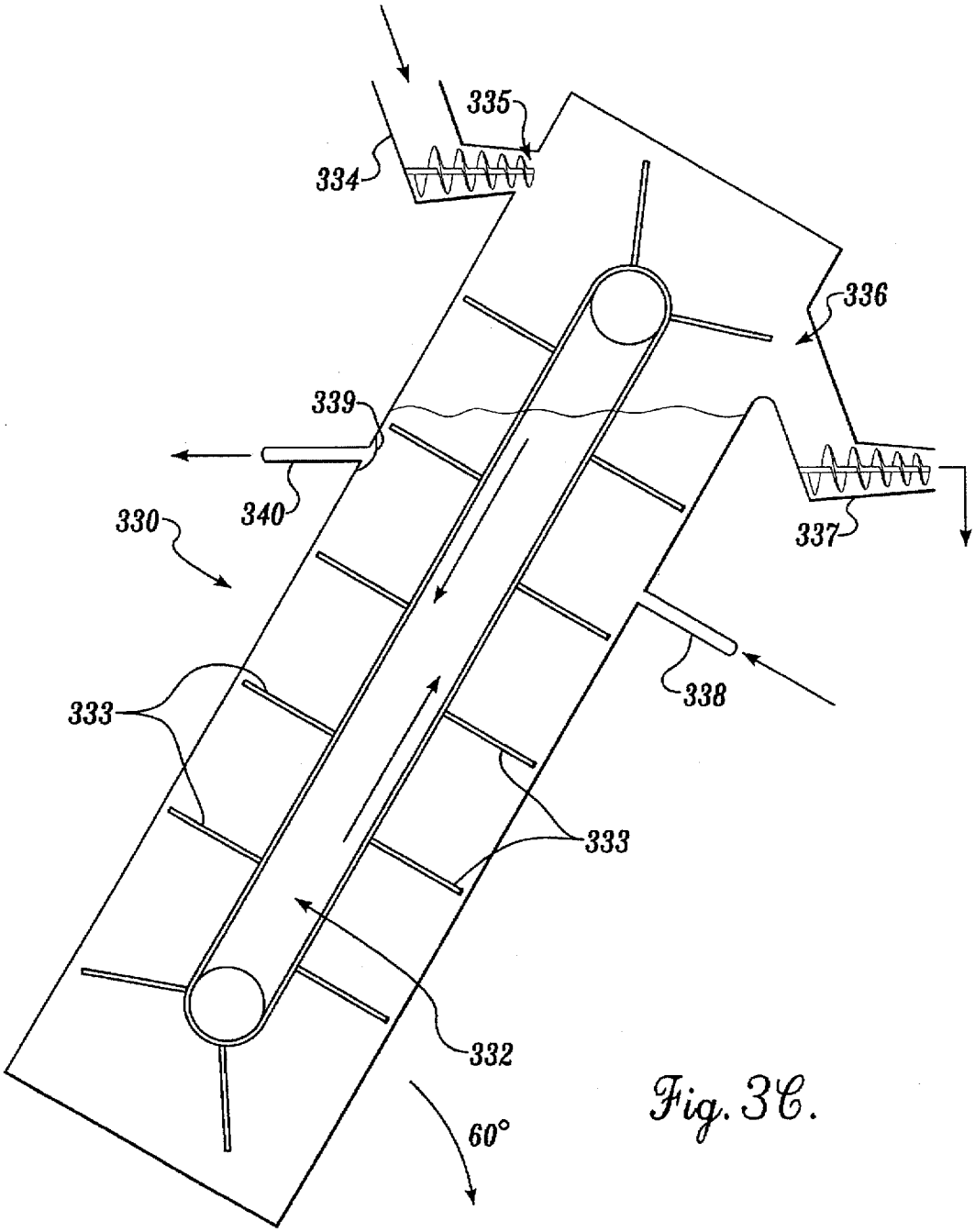
FIG. 3C is a schematic diagram of another embodiment of a chip extractor of the invention.

In yet another embodiment of the chip extractor of the invention, shown in FIG. 3C, the extractor 330 is inclined at an angle of about 60°, and is supplied with an internal pan conveyor 332. As is conventional, the pan conveyor includes an endless belt extending substantially along the central axis of the extractor. Containers, or "pans," for carrying chips are formed along the belt by planar sheets, typically of metal, mounted on, and extending at right angles from, the belt at spaced intervals. The sheets extend toward, but do not touch the internal wall of the extractor. Thus, chips are captured in the spaces between the plates and are carried in the direction of movement of the belt. Chips are fed into the extractor inlet 335 by a compression screw feeder 334, located near the top of the extractor, on one side of the pan conveyor belt, and exit from the extractor through an outlet 336 on the opposite side of the pan conveyor belt, near the top of the extractor. The chips are carried away in a compression screw feeder 337. Solvent enters into the extractor through a conduit 338 near the outlet of the chips, and exits from the extractor through a conduit 340 near the chip inlet 335. Thus, the flow through the extractor is not completely countercurrent, but approximates countercurrent conditions for at least the partially-extracted chips on the exiting side of the pan conveyor.

Figure 3D:
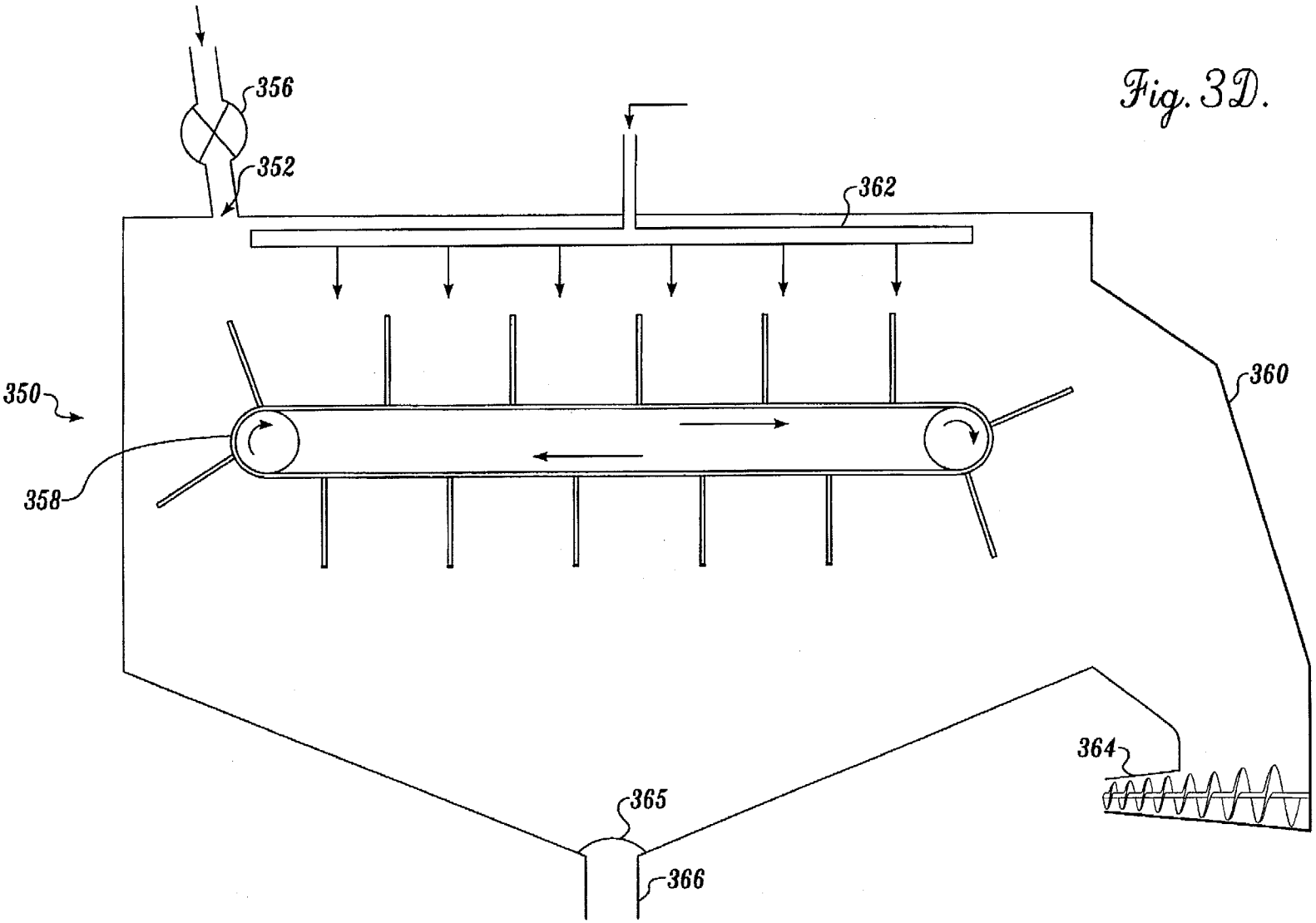
FIG. 3D is a schematic diagram of another embodiment of a chip extractor of the invention.

In a further alternative embodiment of the chip extractor of the invention, shown in FIG. 3D, the extractor 350 is cylindrical (with a horizontal longitudinal axis) with a vee-shaped bottom to allow drainage of solvent. Thus, chips enter through an inlet 352 near one end of the extractor, fed by a rotary valve feeder 356. This type of feeder is an alternative that may also be substituted for the screw feeders shown at the chip inlets of the extractors of FIGS. 3A, B and C. The chips pour onto and are carried by a centrally-mounted longitudinally-extending pan conveyor 358 toward the opposite end of the extractor, while solvent is sprayed over the chips from solvent distributor 362. The chips exit off the end of the conveyer and fall into an exit chute 360. A compression screw feeder 364 then removes the extracted chips for processing into pulp. The solvent is removed through a conduit 366 that has a chip filter 365 and that is located at the base of the extractor.

As can be seen from the above, the extraction of wood extractives from wood chips may be achieved with a variety of extractor designs of the invention. The nature of wood chips, and wood particulates, impose certain limitations on the nature of the equipment. Wood chips, for example, tend to interlock and form stable packed structures when placed within a container, such as an extractor, or a silo. The above-described designs overcome this tendency by providing either inclined screws, pan conveyors, or screws near the base of the extractor to facilitate chip movement in the extractor and chip removal from the extractor. The designs, especially those of FIGS. 3B, 3C and 3D, also reduce channeling of wood chips from inlet to outlet of the extractor and facilitate control of chip residence time in the extractors.

In the extraction stage 58, the wood chips are immersed in the extraction solvent supplied in conduit 148 from solvent storage 146. Mild agitation, while preferred, is not necessary. During the immersion, solvent surrounds and penetrates the wood chips dissolving and leaching wood extractives, including VOCs and pitch, from the structure of the wood chip. Preferably, the solvent penetrates to and removes extractives from the resin canals of the wood as well as the parenchyma cells of the wood. This removal or "leaching" of extractives from the wood takes place under conditions of temperature and pressure that do not cause substantial attack of the ligninor cellulosic component of the wood. Thus, the high temperatures and pressures used in prior art processes designed to delignify wood or to pulp wood using solvents (omen in combination with catalysts) are not employed. Instead, the integrity of the cellulosic component is maintained as wood extractives are leached out. Moreover, the lignin component of the wood is also not affected, or only insignificantly affected, so that the wood particulates are not pulped. Only removal of a sufficient proportion of extractives to substantially reduce subsequent VOC release from the leached wood chips and to reduce the need for pitch-scale treatment chemicals in subsequent pulping operations, is required according to the invention. In certain instances, external heat may be supplied to facilitate leaching. Moreover, in certain instances, pressure may be applied in the extraction process to prevent vaporization of the solvent. However, in the preferred embodiment using acetone as a solvent, external heat may not be needed, nor may pressure have to be applied. Thus, the leaching or extraction can take place at ambient conditions of temperature and at about atmospheric pressure.

The extracted wood chips are separated from solvent in the extractor(s) and transported to optional chip pressing operations 62 for removal of residual solvent and extractives, for instance in screw presses. The solvent, containing water, pitch and VOCs, now called a "miscella" is removed in conduit 60 for processing to recover solvent for reuse, and pitch and VOCs for sale or combustion.

In the optional screw presses, the extracted wood chips are subjected to mechanical pressure causing squeezing and compression of the chips. As a result, residual solvent containing pitch is expressed from the chips. This liquid is conveyed in a conduit 63 to the solvent and pitch recovery processes, as will be described later. The compressed wood chips, still containing residual solvent, are charged to a solvent removal stage 66.

Solvent removal may be effected by conventional means, such as charging to a rotary drum dryer, or continuous dryers that comprise a multiplicity of drying stages enclosed in a housing and subjected to direct contact steam that removes solvent from a substrate to be dried. Solvent vapors removed during this stage are carried by conduit 68 to processes for solvent recovery. The substantially solvent-free leached chips, with reduced VOC and pitch content, are charged to board making or pulping processes, generally designated by the numeral 72. As a result of the extraction of VOCs and pitch, in the process of the invention, VOC emissions during the boardmaking or pulping operations are significantly reduced. Furthermore, as explained above, paper and absorbent product manufacturing processes are enhanced, by the virtual elimination of pitch that causes fouling of equipment and related loss in efficiency and production. The quality of paper and pulp products is also improved, as explained above. Further, if the chips are used in boardmaking, then bonding strength is improved so that board quality is enhanced while VOC emissions are substantially reduced.

In an important aspect of the invention, the extractive solvent used in the VOC and pitch extraction stage is recovered and recycled for reuse. As shown in the illustrative embodiment of FIG. 2, liquid streams 60, 63 and 68 containing solvent, from extractor(s) 56, optional chip pressing 62, and solvent removal 66, respectively, are gathered in header 70 which charges the solvent-containing fluids to a first distillation column 72. The distillation column preferably has three stages of separation, when acetone is used as a solvent. Clearly, the number of stages will vary depending upon physical properties of the extractive solvent used. However, the distillation column may be readily designed with the aid of commercially available multi-component distillation software, such as ASPEN PLUS, supplied by Aspen Technology Inc. of Cambridge, Mass.

In the embodiment shown in FIG. 2, distillation column 72, preferably under partial vacuum pressure, is supplied with steam 74 as a heating medium to raise the liquid in the base of the distillation column to a temperature at or above its bubble point. Under these conditions, vapors containing acetone, VOCs and some water vapor, rise to the top of the distillation column 72 and are removed in overhead conduit 80. These overhead vapors are condensed in cooler-condenser 76, supplied with water at about 20°–25° C. (or cooler) as a cooling medium. The cooler-condenser 76 may be of conventional shell and tube construction, plate and frame construction, and the like. Condensate is removed from the cooler-condenser in conduit 82 and is charged to a solvent, VOC and water storage tank 100.

A bottom product stream 78 is also withdrawn from the first distillation column 72. This bottom product stream contains a much lower proportion of solvent than the charge supplied to the distillation column in conduit 70, but yet contains some solvent, as well as water and pitch. In one embodiment, substantially all of the VOCs are removed in the overhead product from column 72. The substantially VOC-free bottom product is charged to a second distillation column 84 for recovery of solvent. This distillation column 84 is preferably also under partial vacuum, but a greater vacuum than in the first column, is supplied with heat, preferably through higher pressure steam than supplied to the first column, as shown by arrow 88. As a result of the higher temperature at the base of the distillation column and the increased vacuum, any remaining solvent is stripped from the charge to the distillation column. Consequently, a bottom product stream, substantially free of solvent and VOCs, is withdrawn from the distillation column in conduit 90 and charged to separator 120, as will be discussed later. An overhead product stream, containing mainly solvent, some water, and any residual VOCs, is removed from an overhead portion of the distillation column through conduit 86. This vapor stream is condensed in cooler-condenser 92. As before, the cooling medium in this cooler-condenser may be cooling water at about 20°–25° C., or colder. Condensate is carried from the cooler-condenser in conduit 94 and charged to the solvent, VOC, and water storage tank 100.

As explained above, the bottom product stream carried in conduit 90 from the second distillation column 84 contains an insignificant amount of residual solvent, in addition to pitch and water. This bottom product is charged to separator 120, preferably a heated tank, where heat is supplied by internal heating coils to raise the temperature of liquid to a temperature that favors separation of pitch and water, with the aid of a de-emulsifier, and that maintains the pitch in a pumpable viscosity range. Pitch separates from the water and accumulates in a layer. This pitch layer is then withdrawn in conduit 124 for potential sale. As an alternative, the pitch may be burned as a fuel since it has a heating value approximately 85% of that of No. 6 fuel oil. Mother product stream 126, containing mainly water, is also removed from the separator 120. This water is suitable for reuse within the process, as process water, or may be released to other mill uses or recycled back to 84 for further separation.

Rectifier 130 receives charge from the solvent, VOC and water storage tank 100. Thus, rectifier 130 is essentially utilized to separate solvent and VOCs from water, although minor quantities of pitch may also be present. Preferably, rectifier 130 is supplied with steam 134 near its base as a reboil heating medium. As a result of heating liquid in the base of rectifier 130 to its bubble point or above, a bottom product substantially free of VOCs and solvent is produced. This predominantly water-containing product stream is removed in conduit 132, for use in other mill processes or for separation in the separator 120, if it contains significant amounts of residual pitch.

At the same time, the rectifier also produces an overhead product, rich in solvent, that is removed in conduit 136 and charged to a cooler-condenser 140. In this cooler-condenser, the solvent is condensed and the condensate is transported away in conduit 138 to dry solvent storage 146 for reuse in the extraction process. A side drawoff stream from the rectifier 120, containing mainly VOCs, is cooled in cooler 148 and the cooled liquid is routed through conduit 144 to VOC storage tank 150. The stored VOCs are routed to a combustion process 154 for disposal or to sales.

Figure 2A:
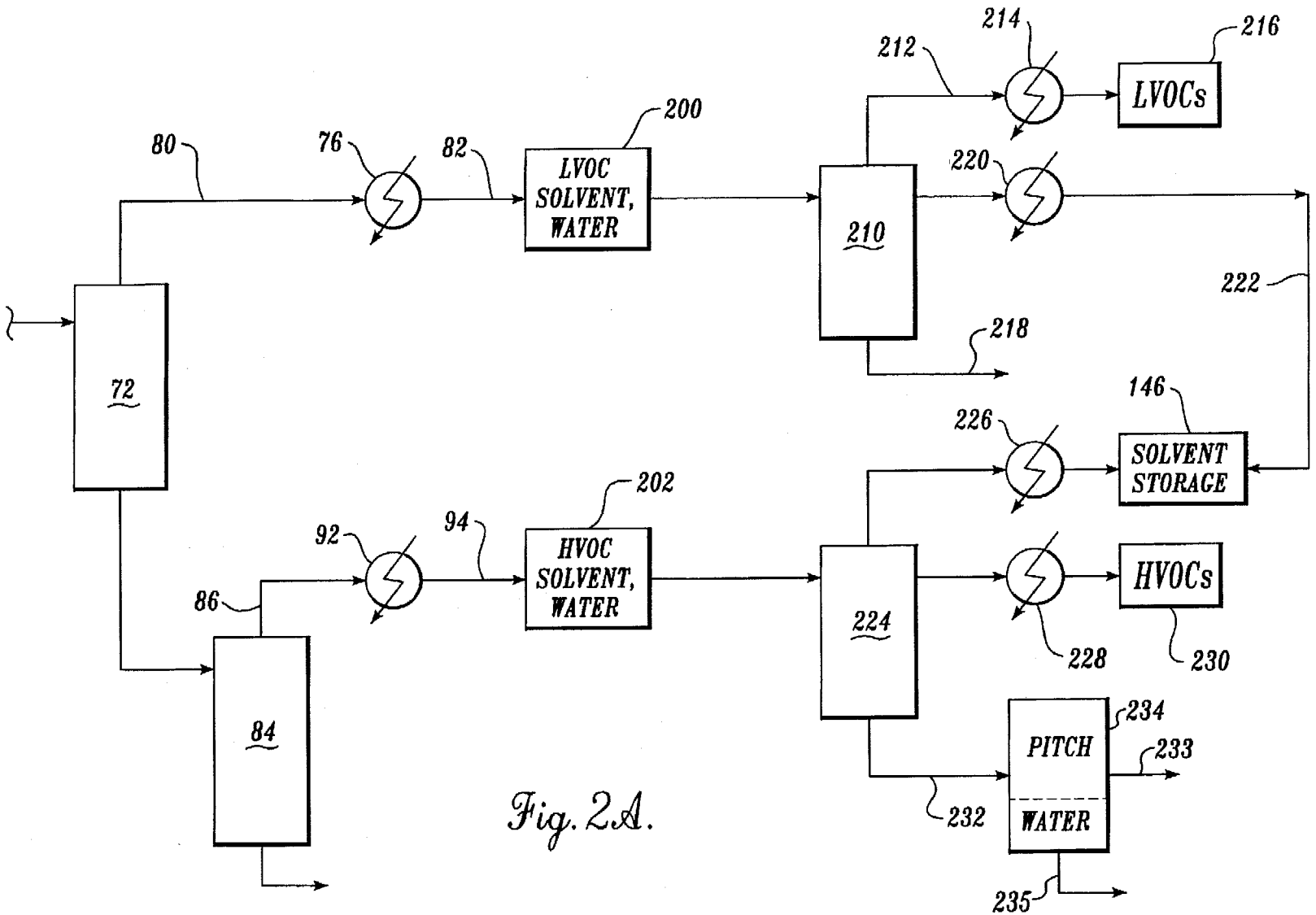
FIG. 2A is a schematic flow diagram of an embodiment of a VOC-solvent-water separation process of the invention.

In an alternative, preferred embodiment, the VOCs are produced as two separate products. With reference to FIG. 2A, the first distillation column 72 produces an overhead product cooled in cooler condenser 76, containing light VOCs (LVOCs) that is stored in LVOC, solvent, and water storage tank 200. The second distillation column 84, produces an overhead product condensed in cooler condenser 92 containing heavier VOCs (HVOCs), and water. Consequently, instead of combining the overhead products by charging both to a single solvent, VOC and water storage tank, the overhead products are kept separate and are charged to separate storage tanks. This allows the production of separate LVOC and HVOC products. In order to produce the separate products, the mixture of LVOCs, solvent and water from storage tank 200 is charged to a rectifier 210 for separation into a bottom stream 218 containing mainly water is routed to reuse or disposal. A middle drawstream 222 containing mainly solvent is condensed in a condenser 220. The condensed solvent is routed to the dry solvent storage tank 146, as in the process described in FIG. 2. Referring again to FIG. 2A, an overhead LVOC product of the rectifier 210 flows through conduit 212 to cooler-condenser 214. The condensed LVOC product is stored in an LVOC storage tank 216.

The HVOC product is produced by charging the mixture in storage tank 202 to a rectifier 224. In this rectifier, the mixture is separated into an overhead product, containing mainly solvent, that is cooled and condensed in a condenser 226 before being charged to dry solvent storage tank 146. A mid-column drawoff stream, containing mainly HVOCs, is cooled in a cooler 228 and then routed to HVOC product storage tank 230. The rectifier bottom product, carried in conduit 232, contains mainly water and pitch. This mixture is routed in conduit 232 to a heated de-emulsifier tank 234 where the pitch separates from the water. The pitch is removed in conduit 233, for sale or use as fuel, while the water is routed in conduit 235 for use in the process, or disposal.

Clearly, the process described in FIG. 2A can also be operated with a single rectifier operating on two cycles. In one cycle, the rectifier is used to separate the mixture from tank 200 into LVOCs, water and solvent. In another cycle, the rectifier is used to separate the mixture from storage tank 202 into HVOCs, solvent and water. Storage tank sizing and distillation columns 72 and 84 overhead product volumes dictate the length of each of the cycles.

Figure 2B:
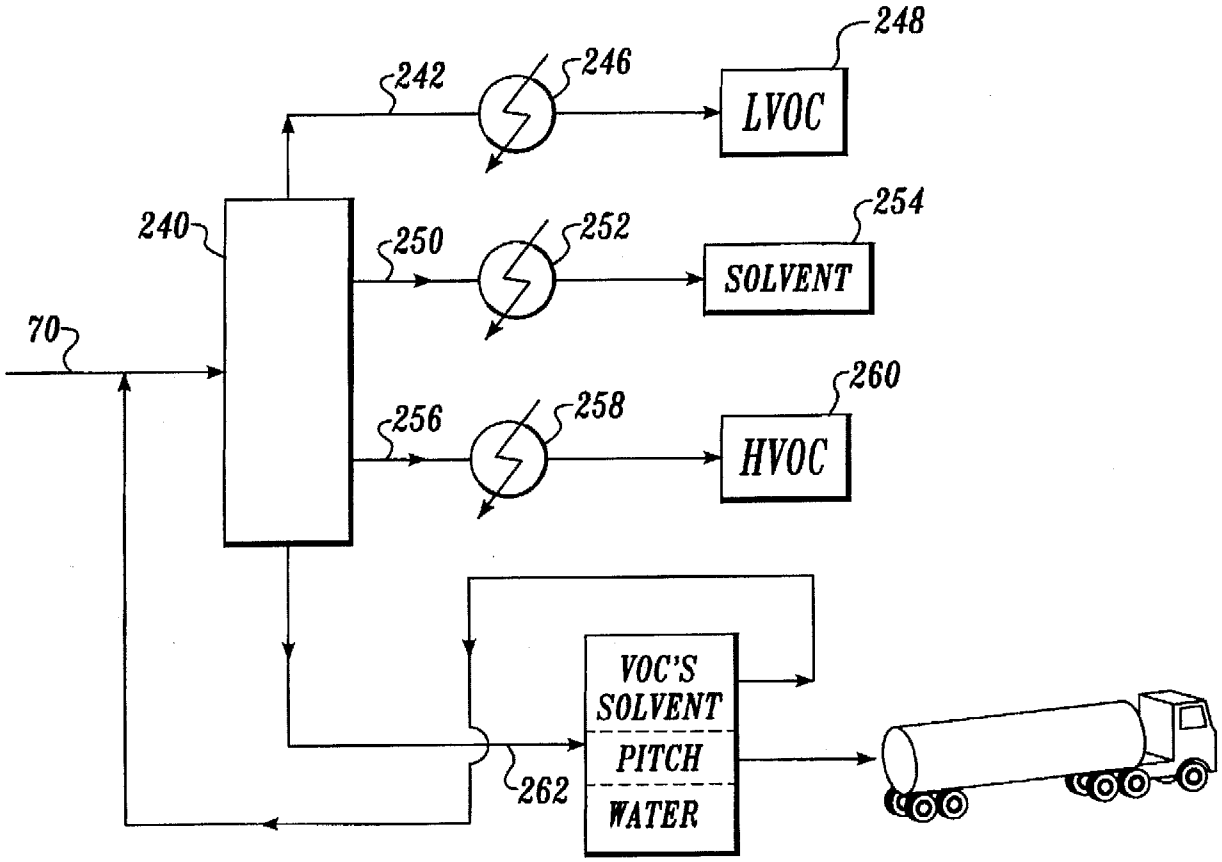
FIG. 2B is a schematic flow diagram of another embodiment of VOC-solvent-water separation process of the invention.

In a further alternative more preferred embodiment, shown in FIG. 2B, the rectifier 130 has an overhead product drawoff, two side product drawoff streams, and a bottom product stream. The overhead stream is rich in LVOCs; an upper near-top-column drawoff stream is rich in solvent; a lower near mid-column draw off stream is rich in HVOCs; and the bottom stream is substantially free of VOCs and solvent but contains pitch and water. This clearly assumes that the boiling point of the selected solvent is intermediate the LVOCs and the HVOCs. If not, then the drawoff configuration may readily be altered to accomplish the separation. Regardless, in the type of rectifier, pump arounds may have to be installed in order to remove or add heat to the distillation column to facilitate separation between the LVOCs, HVOCs, and solvent. The function of these pumparounds is to controlledly modify the temperature profile of the distillation column, thereby facilitating separation of LVOCs and HVOCs and solvent. A person of ordinary skill in the art, having read this disclosure, and having access to distillation column design software, such as the software named above, would readily be able to design a rectifier with appropriate pumparound volume and temperature to achieve the separation.

It is important to note that the volatile organic compound product produced, and the pitch product produced, are not necessarily "pure." Rather, the VOC product may contain at least some, although minimal, amount of solvent, as well as water. Preferably, the amount of solvent in the VOC product is minimized to reduce the cost of adding makeup solvent to the process. Nevertheless, at least some proportion of the solvent will be lost in the VOC, and possibly pitch, products for economical distillation operation.

The pitch product will contain pitch as well as water. Pitch by itself solidifies at room temperature and is difficult to handle. While the pitch may be spray-dried into pellets for handling, it is preferred that the pitch product contain less than about 50 wt % solids so that it may be maintained in a liquid state, either at ambient temperature or with the addition of economically minor amounts of heat or waste heat. This liquid pitch product is more readily pumped into heated tank cars for sale.

The process of the invention removes volatile organic compounds from wood particulates thereby allowing processing of these wood particulates without the release of VOCs into the environment. Moreover, the process of the invention removes pitch from wood particulates thereby facilitating further processing of the wood particulates into useful products. Further, the invention provides two additional useful products, namely, VOCs and pitch, that may be sold as byproducts or used as fuel, thereby enhancing the economics of the process of the invention.

The following examples are illustrative of aspects of the invention and do not in any way limit the scope of the invention, as described above and claimed herebelow.

EXAMPLES

Example 1

Comparison of Solvents for the Removal of Wood Extractives

A series of solvents were tested to determine which was most effective for the extraction of wood extractives, including volatile organic compounds and pitch. In each of the tests, 50 gram batches of oven dried Lodgepole Pine wood chips were extracted with solvent at a solvent:wood mass ratio of 4:1. Samples of each batch were each analyzed for wood extractives, using a modified TAPPI test method T204 om88 with diethyl ether as the extraction solvent, before and after extraction with the test solvents.

In each case, the batch of wood chips was subjected to a batch extraction process. The wood chips were not predried, so that their condition approximated that of wood chips normally received for treatment in a wood pulping facility, or used in a composite wood product manufacturing facility. The wood chips were preheated with atmospheric steam for 30 minutes. During this time, the wood chip temperature rose to about 95° C. The wood chip batch was then immediately submerged in the extraction solvent. In each case, the solvent:wood ratio was 4.0 and the extraction time was 30 minutes. After extraction, solvent was drained from the chips, and the chips were subjected to a second heating cycle of 30 minutes with atmospheric steam. Thereafter, the chips were subjected to a second extraction cycle using the same solvent at the same solvent:wood ratio. After draining solvent from the chips, the chips were analyzed to determine the amount of residual wood extractives. The percent wood extractives removed was calculated for each batch and the results are reported in the accompanying Table 1.

TABLE 1

| Treatment Solvent | Percent Extraction |
|---|---|
| Peracetic Acid | 45.8 |
| Caro's Acid | 14.2 |
| Hypochlorous Acid | 37.5 |
| Deionized Water | 41.0 |
| Acetone/Water 80/20 | 54.4 |
| Acetone 100% | 65.0 |

These results indicate that acetone is the best solvent for the removal of wood extractives from Lodgepole Pine. Acetone has advantages over the use of an 80/20 acetone/water mixture, and is also superior to the other solvents tested. It is theorized, without being bound, that oxidized acids (or alkaline reagents), depend upon chemical reactions that convert wood resins in order to achieve extraction. Not only is this from a thermodynamic perspective not as effective as direct solution of the extractives in an organic solvent, but alkaline extractions have several disadvantages. These include the darkening of wood fibers which would result in higher fiber bleaching costs. Moreover, the nonselective nature of caustic treatments result in loss of yield. Also, caustic extracts are extremely toxic and costly to treat.

Example 2

Process Conditions for the Removal of Wood Extractives

A series of acetone extractions were conducted to determine conditions suited for the efficient removal of wood extractives. In each case, a 50 gram batch of oven dried wood chips was treated in a solvent:wood ratio of 4.0. The wood chip species evaluated were seven batches Ponderosa Pine (PP) and four batches of Douglas Fir (DF) as well as a PP control batch. During the extraction processes, steam preheating time, acetone extraction time, and post-steaming times were varied. Steam was supplied at ambient pressure, and the extractions were carried out at ambient temperatures and pressures. In each case, the extracted wood chips were finally squeezed in a press at 1500 psi for 5 minutes. A modified TAPPI test method, T204 om88, using diethyl ether as the extraction solvent, was used to determine the percentage of wood extractives removed from the samples. The results are shown in Table 2.

TABLE 2

| | Steam #1 | | | Extraction #1 | | Steam #2 | | | Extraction #2 | | Press | Extraction |
|---|---|---|---|---|---|---|---|---|---|---|---|---|
| time, minutes | 0 | 15 | 30 | 15 | 30 | 0 | 15 | 30 | 15 | 30 | 5 | % |
| PP1 | | | | X | | | | | | | X | 62.5 |
| PP2 | | X | | X | | | | | | | X | 48.6 |
| PP3 | | X | | X | | | | | | | X | 53.3 |
| PP4 | | | | X | | | | | X | | X | 64.6 |
| PP5 | | X | | X | | | X | | X | | X | 58.5 |
| PP6 | | | | | X | | | | | X | X | 78.2 |
| PP7 | | | X | | X | | | X | | X | X | 73.0 |
| Control PP | | | | | $H_2O$ | | | | | | X | 17.6 |
| DF | | | | X | | | | | | | | 48.5 |
| DF | | | | X | | | | | | X | | 53.6 |
| DF | | X | | X | | | X | | X | | | 54.2 |
| DF | | | X | | X | | | X | | X | | 57.4 |

From the above table, presteaming with atmospheric steam did not appear to enhance extraction. Indeed, presteaming appears to reduce extraction. While multi-stage extractions show slight increases in overall extraction, this increase may not justify the additional equipment required in a commercial operation. Increasing the extraction time, in a single- or multiple-stage extraction, is effective in increasing the percent wood extractives removed.

Example 3

Variation of Percentage of Wood Extractives Removed with Extraction Time, Using Acetone as a Solvent A batch of Lodgepole Pine chips was sampled and tested as described in TAPPI T204 om88, modified to use diethyl ether as a solvent, to ascertain the amount of wood extractives in the chips. Then, samples of the chips were each treated with acetone for 3, 5, 10, and 20 minutes, respectively. Each extracted chip sample was then air dried, ground to 1 mm size particulates, and extracted in the same modified TAPPI method to determine residual wood extractives. The percent wood extractives removed was calculated for each extracted sample and the results were tabulated in Table 3.

TABLE 3

| Time of Extraction (min) | Ether Extractables (wt. %) | Extraction % |
|---|---|---|
| 0 | 2.9 | 0 |
| 3 | 2.3 | 21 |
| 5 | 1.9 | 35 |
| 10 | 1.5 | 48 |
| 20 | 0.75 | 74 |

The results show that wood extractives were reduced from 2.9% in the raw Lodgepole Pine chips to 0.75 wt. % in 20 minutes. This represents an extraction of about 75% of the wood extractives. Moreover, after only 5 minutes, 35% of the wood extractives have been removed. Tests indicated that volatile organic compounds were virtually completely removed from the chips, even after only 5 minutes. Thus, longer extraction time are only needed if it is desired to remove increasing quantities of pitch. It is theorized, without being bound, that lower molecular weight wood extractives are more soluble and are therefore extracted at a faster rate than the higher molecular weight components. Consequently, VOCs are first removed, followed by those wood extractives that are likely to become volatilized under wood chip pulping conditions, and composite board making conditions. Therefore, extraction need only proceed to remove these components, unless higher molecular weight, less soluble pitch must also be removed for other purposes.

Example 4

Comparison of Alternative Solvents for the Removal of Wood Extractives

A series of wood chip extractions were conducted with organic solvents to determine their relative ability to leach extractives from wood. The solvents include methanol, ethanol, 2-propanol, methyl iso-butyl ketone, hexane, acetone, and water.

Samples of raw Lodgepole Pine wood chips were each extracted according to TAPPI T204 om88, modified to use diethyl ether as a solvent, to determine initial wood extractives content. In a first comparison, batches of wood chips were each extracted with a specific solvent, at its boiling point, for either 20 minutes or 4 hours, respectively. The extracted wood chips were then air dried, ground to 1 mm size, and again extracted with diethyl ether, in the modified TAPPI test method T204 om88, to determine residual wood extractives.

A second set of wood chip samples were first air dried, then ground to 6 mm particle size, before being extracted for 4 hours at the solvent boiling point. Thereafter, the extracted wood particulates were ground to 1 mm size, and extracted with diethyl ether, as above, to determine residual wood extractives.

Finally, samples of wood meal were also extracted with each solvent for 4 hours at the solvent boiling point to determine the limit of wood extractives removal achievable with the particular solvent. The percentage of wood extractives removed in each extraction was calculated and the results are tabulated in Table 4.

TABLE 4

| | % Extractives Removed | | |
|---|---|---|---|
| Extraction Conditions Sample Type | 20 minute Reflux chips 6 mm | 4 hour Reflux chips 6 mm | 4 hour Reflux wood meal |
| Methanol | 68 | 75 | 95 |
| Ethanol | 62 | 73 | 96 |
| 2-Propanol | 66 | 75 | 94 |
| Acetone | 67 | 75 | 96 |
| Methyl Isobutyl Ketone | 41 | 70 | 96 |
| Hexane | NA | 18 | 86 |
| Water | 21 | 17 | 38 |

As can be seen from the above table, the hydrophilic solvents appear to be superior to the hydrophobic solvent, hexane, as an extraction solvent. Moreover, percent extraction increases with time of extraction, although the increase is small relative to the increase in time required. Methanol and acetone appear to be the best solvents. However, methanol poses toxicity issues.

Based on the percentage extraction achieved with wood meal, the practical upper limit of wood extractive removal appears to be about 95%. However, as explained before, virtually all volatile organic compounds will be removed, and the residual wood extractives are expected to comprise only the higher molecular weight, and specifically, more hydrophobic, wood extractive components.

Example 5

Determination of the Effect of Wood Particle Size and Handling Conditions on Removal of Wood Extractives In order to test the effect of particle size, wood chips were treated in equipment that would either (1) reduce average particle size or, (2) cause fractures in the wood chips opening internal surfaces and reducing average chip thickness. A batch of chips was treated with a Rader DynaYield Chip Conditioner, designed to squeeze those wood chips that have a thickness greater than 1.5 mm. In this conditioner, the greater the thickness of the charged wood chip, the more work is applied to the wood causing delamination along the wood grain. In effect, this reduces the apparent particle thickness without significantly decreasing chip size or integrity.

Another batch of chips was treated in a Prex screw press. This equipment causes a larger size reduction. However, it is also known that the quality of pulp produced from chips treated through a screw press, or like equipment, such as the Sprout-Bauer Pressifine, French Oil Press, and Prex screw is minimally affected.

A sample of the wood chips was extracted using TAPPI T204 om88 test method, modified to use diethyl ether as a solvent, to determine the percent wood extractives present. Those chip batches treated in the Rader Chip Conditioner and the Prex screw feeder and a control batch were each separately extracted with acetone, under the same conditions of concentration, solvent:wood ratio, temperature and pressure. A sample of the extracted chips was again analyzed by the TAPPI method to determine residual wood extractives. The percentage of wood extractives removed was calculated. The results are shown in Table 5.

TABLE 5

| Wood Chip Size | Control Chip | Rader Conditioner | Prex Screw |
|---|---|---|---|
| Over Thick > 10 mm | 60% | 72% | — |
| <10 mm | 58% | 78% | 84% |
| <6 mm | 65% | 67% | 88% |
| Pins | 82% | — | — |
| Fines | 91% | — | — |

As shown in the table, treating chips in a Rader conditioner allows some increase in the removal of wood extractives, especially for larger size wood chips. This is to be expected, since fracturing the larger wood chips allows better penetration of the solvent into the interior of the chip.

The effect of increased extraction is even greater with chips treated with the Prex Screw equipment. Again, this is explained by the greater degree of size reduction and fracturing of the chips that is achieved with this equipment that facilitates penetration by the solvent into the chip and removal of wood extractives.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A method of removing volatile organic compounds and pitch from wood chips, the method comprising:

(a) contacting the wood chips with a solvent for volatile organic compounds and pitch;

(b) extracting volatile organic compounds and pitch from the chips into the solvent under mild conditions of temperature and pressure to produce extracted wood chips;

(c) separating a miscella comprising solvent, volatile organic compounds, and pitch from the extracted wood chips;

(d) recovering solvent from the extracted wood chips and the miscella; and (e) recycling the recovered solvent for reuse in contacting with wood chips to extract volatile organic compounds and pitch.

2. The method of claim 1, wherein the step of recovering solvent from extracted wood chips comprises heating wood chips soaked with solvent to vaporize solvent from the wood chips.

3. The method of claim 1, wherein the step of recovering solvent comprises subjecting the wood chips to pressure to express residual solvent and pitch from the chips.

4. The method of claim 1, wherein the step of recovering solvent from the miscella comprises distilling the miscella to reclaim solvent and produce a separate product comprising pitch.

5. The method of claim 1, wherein the contacting comprises contacting with a solvent miscible in water.

6. The method of claim 1, wherein the solvent is selected from the group consisting of trichloromethane, diethyl ether, methanol, ethanol, propanol, acetone, methyl ethylketone, kerosene, and methyl isobutylketone.

7. The method of claim 5, wherein the step of extracting is carried out at ambient temperature and pressure.

8. A method of removing extractable components from wood particulates, the method comprising:

(a) contacting the wood particulates with a solvent for wood extractable components;

(b) leaching extractable wood components from the wood particulates into the solvent under mild conditions of temperature and pressure to produce leached wood particulates and a miscella comprising solvent and extractable wood components;

(c) separating the leached wood particulates from the miscella;

(d) recovering a solvent component and wood extractable components from the miscella; and (e) recycling the recovered solvent component to the step of contacting with wood particulates.

9. The method of claim 8, wherein the recovering of a solvent component and wood extractives comprises distilling the miscella to produce separate solvent and wood extractive distillation products.

10. The method of claim 9, wherein the recovering of the solvent component comprises distilling to produce a first product comprising solvent and a second product comprising volatile organic compounds; and de-emulsifying a distillate to produce a third product comprising pitch.

11. The method of claim 8, wherein the leaching of wood extractables is leaching under ambient temperature and pressure conditions in a continuous countercurrent extractor.

12. The method of claim 8, wherein the contacting is with a solvent miscible in water.

13. A continuous process for removing volatile organic compounds and pitch from wood chips, the process comprising:

(a) immersing wood chips in a solvent effective for extracting volatile organic compounds and pitch from the chips for a period of time sufficient to remove from about 50 to about 100% of the volatile organic compounds, and from about 40 to about 80% of the pitch, from the chips to produce extracted chips;

(b) separating extracted chips from a miscella comprising solvent and, volatile organic compounds and pitch; and (c) processing the miscella to produce a recyclable solvent product, a volatile organic compound product, and a pitch product.

14. The process of claim 13, wherein the immersing in a solvent comprises immersing in a water-miscible solvent.

15. The process of claim 13, wherein the processing of the miscella comprises distilling the miscella.

16. The process of claim 13, wherein the immersing is under ambient conditions of temperature and pressure.

17. The process of claim 13, wherein the immersing in a solvent comprises immersing in acetone.

18. The process of claim 13, wherein the immersing is at a solvent:wood chip ratio of from about 6:1 to about 1:1.

19. The process of claim 13, wherein the immersing is at a solvent:wood chip ratio of about 2:1.

20. The process of claim 13, wherein the processing of the miscella comprises recovering at least about 95% of the solvent of the immersing step in the recyclable solvent product.

21. The process of claim 13, wherein the solvent comprises a mixture of a first solvent for unsaponifiable wood extractives and a second solvent for saponifiable wood extractives.

22. A method of extracting volatile organic compounds and pitch from wood particulates, the method comprising:

extracting the particulates with a solvent under mild conditions of temperature and pressure without significant dissolution of lignin from the particulates and without significant attack of cellulosic components of the particulates to produce extracted wood particulates having significantly reduced pitch content and substantially reduced volatile organic compound content;

separating a miscella containing the solvent from the extracted wood particulates; and recovering the solvent from the miscella.

23. The method of claim 22, wherein the extracting comprises extracting to reduce a naturally-occurring pitch content of the wood particulates by about 40 to about 80%.

24. The method of claim 22, wherein the extracting comprises extracting to reduce naturally-occurring volatile organic compound levels of the wood particulates by from about 50 to about 100%.

25. The method of claim 22, wherein the extracting comprises extracting with a mixture of solvents.

26. The method of claim 22, wherein the mild conditions of extracting comprise a temperature in the range from about 20° C. to about 130° C. and a pressure in the range of about 15 to about 25 psi.

27. The method of claim 22, wherein the extracting comprises extracting with a solvent:wood ratio in the range from about 4:1 to about 1:1.

28. The method of claim 22, wherein the extracting is with at least one water-miscible solvent.

29. The method of claim 28, wherein the at least one solvent forms only a minimal azeotrope with water.

30. The method of claim 22, wherein the extracting with a solvent comprises extracting with acetone.

* * * * *

UNITED STATES PATENT AND TRADEMARK OFFICE

CERTIFICATE OF CORRECTION

PATENT NO. : 5,698,667

DATED : December 16, 1997

INVENTOR(S) : J.R. Speaks et al.

It is certified that error appears in the above-identified patent and that said Letters Patent is hereby corrected as shown below:

| COLUMN | LINE | |
|---|---|---|
| [73] Pg. 1, col. 1 | Assignees | "Assignees" should read --Assignee-- |
| [73] Pg. 1, col. 1 | Assignees | Please delete "Weyerhaeuser Company, Tacoma;" and "both of" |

Signed and Sealed this

Ninth Day of June, 1998

*Attest:*

*Attesting Officer*

Bruce Lehman

BRUCE LEHMAN

*Commissioner of Patents and Trademarks*